United States Patent [19]

Bruggisser et al.

[11] Patent Number: 4,768,443

[45] Date of Patent: Sep. 6, 1988

[54] WORKING APPARATUS, ESPECIALLY A CLEANING APPARATUS USED IN CONJUNCTION WITH A TEXTILE MACHINE

[75] Inventors: Bruno Bruggisser, Wettingen; Walter Gehrig, Muri, both of Switzerland

[73] Assignee: Luwa AG, Zürich, Switzerland

[21] Appl. No.: 929,437

[22] Filed: Nov. 12, 1986

[30] Foreign Application Priority Data

Nov. 18, 1985 [CH] Switzerland ..... 04916/85

[51] Int. Cl.[4] ..... B08B 5/02; B61B 13/00

[52] U.S. Cl. ..... 104/173.1; 104/302; 74/37; 15/312 R; 15/319

[58] Field of Search ..... 104/235, 302, 303, 89, 104/165, 173.1, 90; 15/312 A, 312 R, 319; 74/37, 89.2; 310/168

[56] References Cited

U.S. PATENT DOCUMENTS

| | | | |
|---|---|---|---|
| 1,517,961 | 12/1924 | Cummings et al. | 15/312 R X |
| 2,886,843 | 5/1959 | Bahnson, Jr. | 104/302 X |
| 3,273,408 | 9/1966 | Nagel et al. | 74/37 X |
| 4,258,450 | 3/1981 | Sohler | 15/312 A |
| 4,318,018 | 3/1982 | Kennedy | 310/168 X |
| 4,333,772 | 6/1982 | Mulligan et al. | 15/312 R X |

*Primary Examiner*—Robert B. Reeves
*Assistant Examiner*—Scott H. Werny
*Attorney, Agent, or Firm*—Werner W. Kleeman

[57] ABSTRACT

The working apparatus, useful as a cleaning apparatus for textile machines, comprises a mobile servicing or working unit possessing a ventilator cooperating with air guide elements and operates in cleaning zones located at these textile machines. The servicing unit is movable on a track or rails. A stationary drive motor provides the relatively high power drive for the travel motion of the servicing unit along the track and for the ventilator by means of an endless belt trained over transmission members arranged at the servicing unit. These transmission members each contain different size coaxially arranged pulleys. By changing the position of one strand or run of the belt from a smaller size to a larger size pulley and vice-versa, the direction of movement of the travelling servicing unit can be selectively reversed. The movement of the servicing unit is monitored by a control device arranged at the servicing unit with the aid of terminal or limit switches and sensors. The power required by the control device is supplied by a generator co-movable with the servicing unit and driven by the belt.

10 Claims, 4 Drawing Sheets

WORKING APPARATUS, ESPECIALLY A CLEANING APPARATUS USED IN CONJUNCTION WITH A TEXTILE MACHINE

BACKGROUND OF THE INVENTION

The present invention broadly relates to a new and improved working apparatus or arrangement, in particular, but not exclusively, serving as a cleaning apparatus and, more specifically, pertains to a new and improved construction of a cleaning apparatus useful in conjunction with a textile machine.

Generally speaking, the working apparatus of the present invention comprises a servicing or working unit which travels to-and-fro upon a track or rails. The servicing unit is driven and caused to move by means of a stationary drive motor along the rails or track and is equipped with a control or control device for detecting obstacles located along the path of travel of the working apparatus. This working apparatus is especially useful for cleaning sundry types of textile machines arranged in the direction of the path of travel of the servicing or working unit.

As far as the servicing or working unit is concerned, as alluded to above, such could, for example, be a cleaning apparatus which is displaceable or reciprocatable on overhead rails or on an overhead track positioned in the longitudinal direction of one or more textile machines arranged in succession in order to periodically rid them of dust and fly or other contaminants by means of compressed or blow air and suction air. This blow air and suction air is generated by a ventilator positioned at the travelling or mobile servicing or working unit and is delivered to the cleaning zones by means of air guide elements or ducts.

It is known to provide such reciprocating or travelling servicing units with a control device for detecting obstacles which would hinder the proper operation of the servicing unit. Optical or electro-mechanical detectors may be employed which, upon detection of obstacles, stop or, as the case may be, reverse the direction of movement of the servicing unit.

These known servicing units all have in common the feature that the power or current supply from the power mains for operating the ventilator as well as also for accomplishing the travelling movement of the servicing unit is effected through current rails or trailing or drag cables. Disadvantages arising from this kind of power supply reside, on the one hand, in the undesired sparking phenomenon and in the frequently occurring contact interruptions arising between the current rail and the collector or contact shoe or the like and, on the other hand, in the cumbersome guiding of the trailing or drag cables. The current contact shoes or collectors are subject to substantial wear and often have to be replaced. Also, the control of the movement of the servicing unit is laborious and complicated.

A drive apparatus is already known which avoids certain of these drawbacks by employing an endless transmission member operatively coupled with a stationary drive motor to effect movement of a carriage having a ventilator impeller. Significant in this regard is Swiss Patent No. 413,680.

SUMMARY OF THE INVENTION

Therefore, with the foregoing in mind, it is a primary object of the present invention to provide a new and improved construction of a working apparatus, especially a cleaning apparatus used, for instance, in conjunction with a textile machine, which does not exhibit the aforementioned drawbacks and shortcomings of the prior art constructions.

Another and more specific object of the present invention aims at providing a new and improved construction of a working apparatus of the previously mentioned type in which the power supply to the control device which is located at the servicing unit and which serves to detect obstacles, is accomplished in such a manner that there can be avoided the use of trailing or drag cables or wear-prone mechanical contact members.

Yet a further significant object of the present invention aims at providing a new and improved construction of a working apparatus of the character described which is relatively simple in construction and design, extremely economical to manufacture, highly reliable in operation, not readily subject to breakdown and malfunction and requires a minimum of maintenance and servicing.

Now in order to implement these and still further objects of the present invention which will become more readily apparent as the description proceeds, the working apparatus of the present invention is manifested by the features that the electric power or current supply for the control device is generated by a generator co-movable with the servicing unit and this generator is driven by virtue of the movement of the servicing unit.

Because of the arrangement of a generator which is movable in conjunction with the servicing or working unit, the necessary electrical power supply for the control device, which is small anyway, is accomplished in an exceedingly simple manner.

It is particularly advantageous to locate the generator in one of the transmission members movable in conjunction with the servicing unit, and the generator drive member is operatively connected to a rotatable part of this transmission member.

A preferred embodiment proposes equipping the travelling or mobile servicing or working unit with transmission members or elements about which there is trained a drive belt or equivalent structure. Each of these transmission members or elements comprises three coaxially arranged belt pulleys or pulley disks. The three coaxially arranged belt pulleys or pulley disks of each transmission member possess different diameters. The drive belt is trained about these transmission members or elements.

A particularly advantageous construction is realized in the foregoing case if the one outer belt pulley or pulley disk of each transmission member is smaller than the other outer belt pulley or pulley disk of such transmission member. This other outer belt pulley or pulley disk of each transmission member, in turn, is smaller than the intermediate or middle belt pulley or pulley disk of such transmission member. The one strand or run of the drive belt is constantly guided in a serpentine or snake-like path of travel over the belt pulley or pulley disk of intermediate diameter size, whereas the other run or strand of the drive belt, depending upon the desired direction of travel of the servicing unit, is selectively guided, likewise in a serpentine or snake-like path of travel, over the belt pulley or pulley disk of largest diameter or smallest diameter, as the case may be. The other run or strand of the belt is guided in the aforementioned serpentine path of travel from the opposite side of each of the related transmission members in relation to the serpentine path of travel of the one strand or run of the drive belt. Stated in another way, the two runs or strands of the drive belt are guided over the transmission members in respective serpentine paths of travel which are basically in mirror image relationship to one another. This arrangement is particularly advantageous since such construction allows for a change in the direction of travel of the reciprocatable or to-and-fro movable servicing unit in a very simple manner and this change of the direction of travel does not impede in any way nor interrupt driving of the generator.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
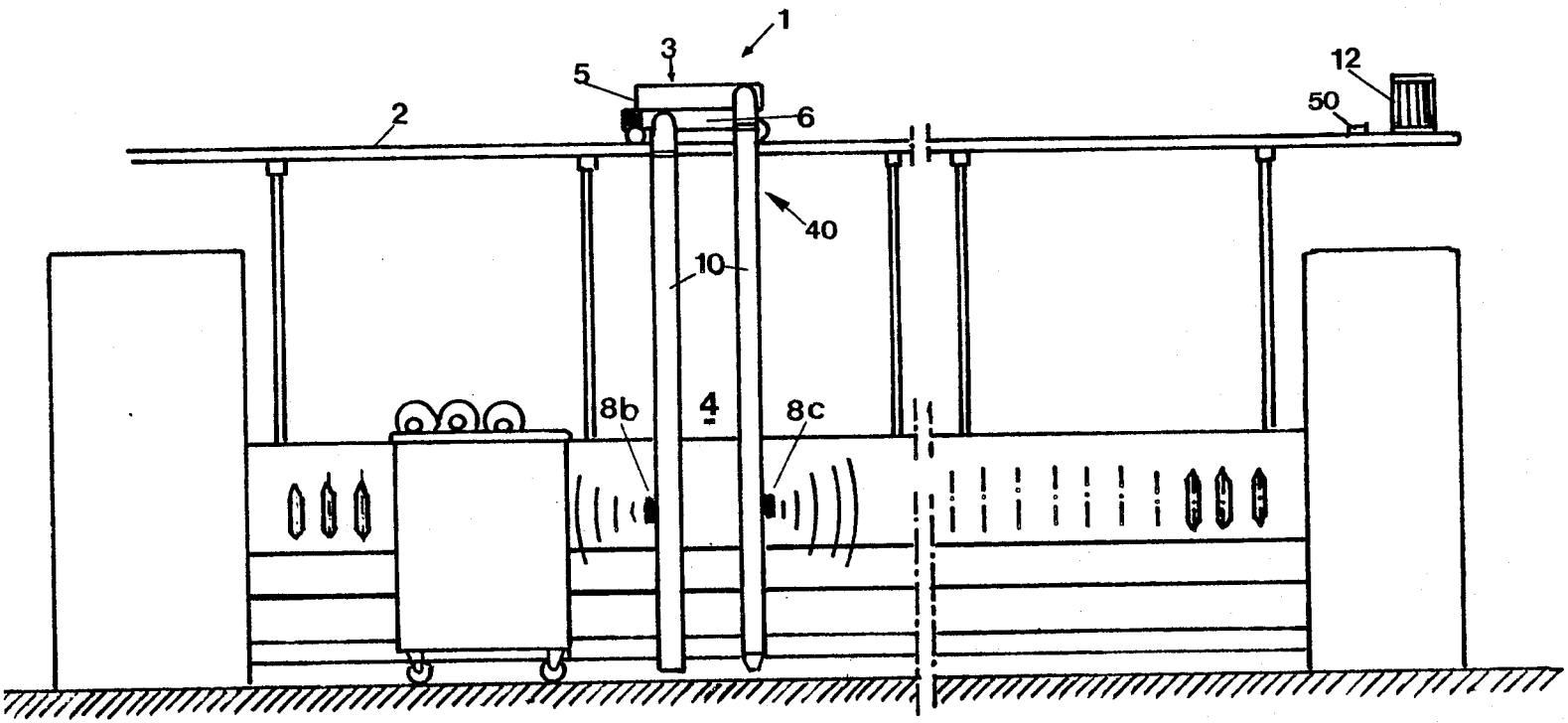
FIG. 1 shows the general layout of a working apparatus according to the invention in conjunction with a textile machine in a lengthwise side elevation.
Figure 2:
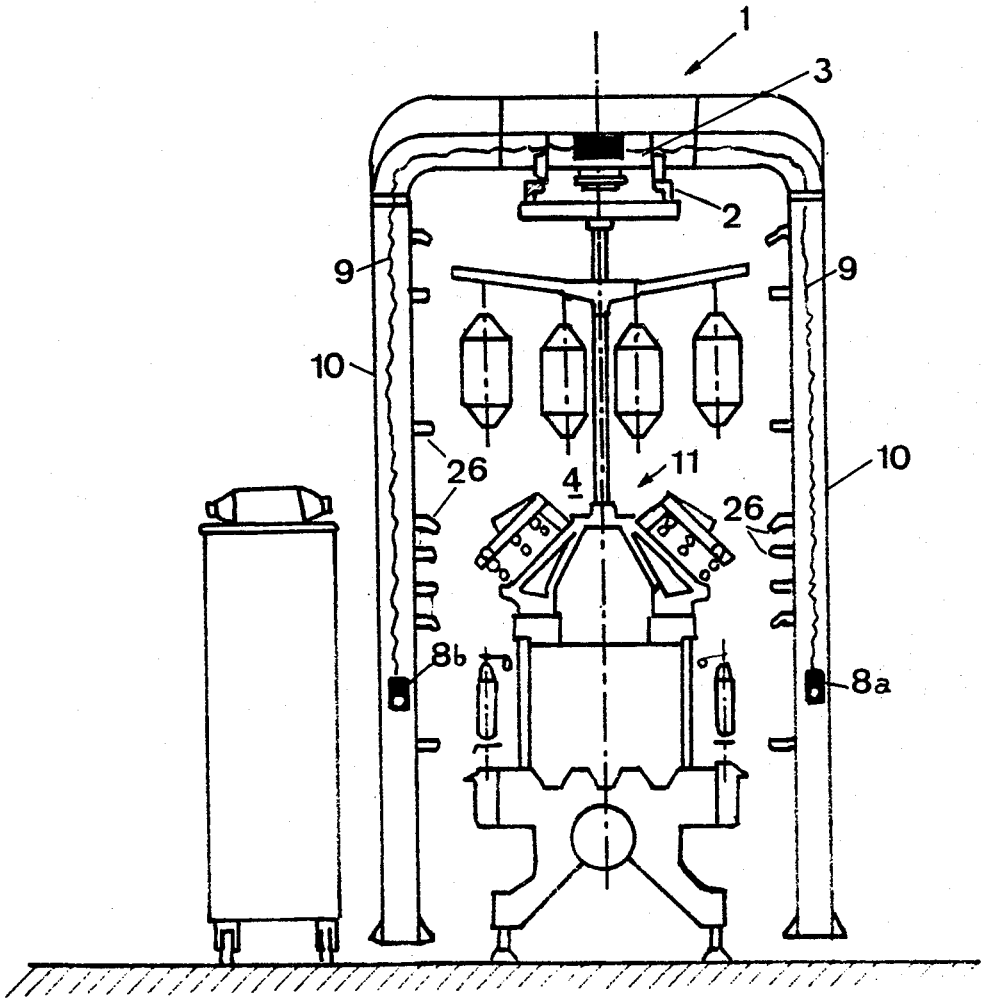
FIG. 2 shows the working apparatus as depicted in FIG. 1 in a front elevational view.

Describing now the drawings, it is to be understood that to simplify the showing thereof only enough of the structure of the working apparatus, here shown by way of example as a cleaning apparatus for a textile machine, has been illustrated therein as is needed to enable one skilled in the art to readily understand the underlying principles and concepts of the present invention. Turning now specifically to FIGS. 1 and 2 of the drawings, the working apparatus illustrated therein by way of example and not limitation is, as stated, designed for instance as a mobile cleaning apparatus which is reciprocatably movable along one or more textile machines arranged in succession or behind one another, such as, for instance, spinning machines or twisting machines or twisters in order to periodically clean such equipment from dust and fly or other contaminants by means of compressed or blow air and suction air.

The working apparatus 1, designed as a cleaning apparatus, comprises a trolley or carriage 3 which is displaceable upon two horizontal rails or track 2. The rails or track 2 are dispositioned proximate to and, for instance, above the textile machines. The carriage 3 is equipped with transmission members or elements 16, 17, 18, a ventilator 5 as well as a control device or control 6 provided with terminal or end switches 7*a* and 7*b*. Furthermore, there are provided four sensors or detectors 8*a*, 8*b*, 8*c* and 8*d* which are all connected to the control device 6 through lines or conductors 9. Connected to the not particularly referenced housing of the ventilator 5 are air guide elements or airflow ducts 10 which extend at both sides of the textile machine almost to machine floor level. These air guide elements or airflow ducts 10 form therebetween servicing or cleaning zones 4, in which zones 4 cleaning of the relevant textile machines, generally designed by reference numeral 11, is effected by means of compressed or blow and suction air. The working or servicing unit, generally indicated by reference character 40, is moved to-and-fro along these textile machines 11 such that the textile machines 11 are located in the cleaning zones 4 between the air guide elements or airflow ducts 10.

Figure 3:
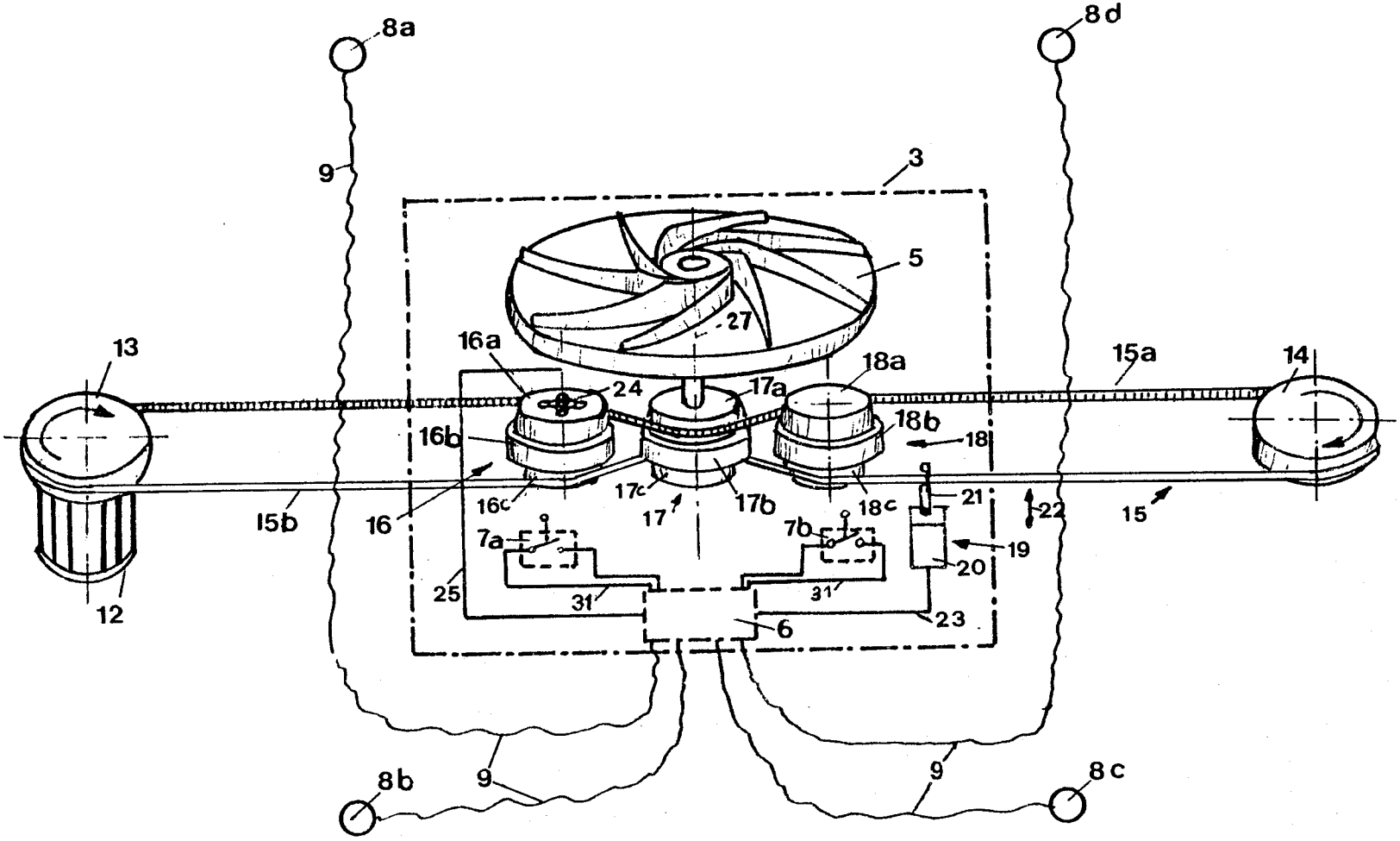
FIG. 3 is a schematic illustration, partially in perspective, of the details of the drive and control structure.

Turning now to FIG. 3, a stationary drive means or electric drive motor 12 with a drive pulley 13 or equivalent drive element is fixedly positioned at one end of the track or rails 2 defining the path of travel through which moves the servicing or working unit 40. A transmission element in the form of an endless drive belt 15 extends between and is trained over this drive pulley 13 and a deflection or return pulley 14 located at the other end of the servicing unit-travel path defined by the track or rails 2. This endless drive belt 15 also is trained about the here depicted three transmission members or elements 16, 17 and 18, as will be described in detail hereinafter. Each transmission member 16, 17 and 18, possesses three interconnected belt pulleys or pulley disks 16*a*, 16*b*, 16*c*; 17*a*, 17*b*, 17*c* and 18*a*, 18*b*, 18*c*, respectively, the individual belt pulleys or pulley disks of the same transmission member or element differing in diameter from one another. The dimensions thereof are chosen such, that the outer or lowest belt pulley or pulley disk 16*c* has a smaller diameter than the other outer or uppermost belt pulley 16*a* which, in turn, has a smaller diameter than the middle or intermediate belt pulley 16*b* of largest size. The same holds for the belt pulleys or pulley disks 17*a*, 17*b*, 17*c* and 18*a*, 18*b*, 18*c* of the other transmission members 17 and 18, respectively.

The working apparatus 1 is designed such that the rear run or strand 15*a* of the endless drive belt 15 is constantly guided over the upper intermediate size belt pulleys 16*a*, 17*a* and 18*a* in a snake-like or serpentine fashion, i.e. contacts for example in sequence the back portion of belt pulley 16*a*, the front portion of belt pulley 17*a* and the back portion of belt pulley 18*a*, as seen by an observer looking at FIG. 3. The front strand or run 15*b*, closer to the observer of the showing of FIG. 3, may be selectively or alternatively operatively guided over either the lower smallest size belt pulleys 16*c*, 17*c* and 18*c* or the middle or intermediate belt pulleys 16*b*, 17*b* and 18*b*, of largest size or the upper belt pulleys 16*a*, 17*a* and 18*a* of intermediate size. In all cases the front or closest situated strand or run 15*b* always contacts or engages the transmission members 16, 17 and 18 basically in the reverse or mirror-image fashion with regard to the rear or furthest situated strand 15*a*. The path of each of the belt strands or runs 15*a* and 15*b*, as stated, extends along a respective snake-like line or serpentine path.

A belt changeover or shifter or device 19 serves to selectively change the path of travel of the front or closest situated strand 15*b*. This belt changeover or shifter device 19 comprises a solenoid or electromagnet 20 or equivalent structure and a belt guide member 21 embracing or operatively engaging with the front belt strand or run 15*b*. The solenoid or electromagnet 20 selectively moves the belt guide member 21 in either one of the directions indicated by the double-headed arrow 22. A line or conductor 23 connects the solenoid or electromagnet 20 with the control device 6. It should be pointed out that an electric motor may be also utilized instead of the solenoid or electromagnet 20 or, in fact, any other appropriate belt shifting structure.

The lower belt pulleys or pulley disks 16c, 17c and 18c are all of the same size and, as stated, smaller in size than the upper belt pulleys or pulley disks 16a, 17a and 18a which, in turn, are also all of the same size. By virtue of the difference in the circumferential speeds and the thus produced differential torques existing at the upper belt pulleys 16a, 17a and 18a, on the one hand, and at the intermediate or middle belt pulleys 16b, 17b and 18b or the lower belt pulleys 16c, 17c and 18c, respectively, on the other hand, there is brought about a movement of the carriage 3 in the one or the other direction due to the thus generated resultant force. In other words, due to the differential torque exerted by the front and rear strands or runs 15b and 15a of the drive belt 15 upon their related different size belt pulleys the carriage 3 can be caused to selectively migrate or travel in the one or the other direction, depending upon whether the front strand or run 15b engages with the lowermost smaller size belt pulleys 16c, 17c and 18c or the larger size middle or intermediate belt pulleys 16b, 17b and 18b. In the event that the front strand or run 15b is shifted with the aid of the belt changeover or shifter device 19, from the lower belt pulleys 16c, 17c, 18c to the intermediate or middle belt pulleys 16b, 17b, 18b, then there results a differential or resultant force which is effective in the other direction to bring about an oppositely directed motion or travel of the carriage 3 from what it previously had. If the belt pulleys 16a, 17a and 18a are each provided with an additional groove for guiding the front or closest situated strand or run 15b then this front strand or run 15b can be moved or displaced upwardly completely onto the upper belt pulleys 16a, 17a and 18a. In this case, the endless drive belt 15 revolves but now obviously the carriage 3 does not move.

Figure 4:
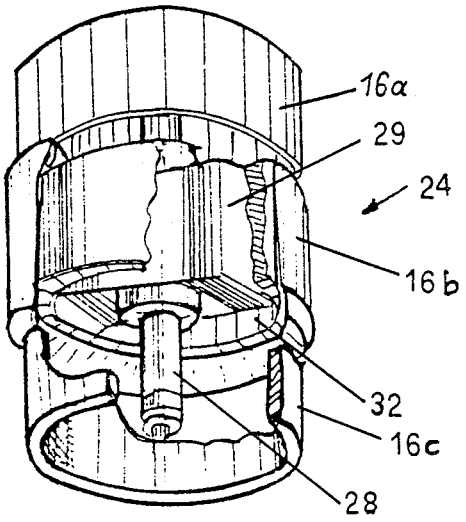
FIG. 4 shows a perspective view of one of the transmission elements with the built-in generator or generator unit.

With reference to FIG. 4, the power or current supply for the control device 6 is effected with the aid of, for instance, a brushless generator or generator means 24 installed within the transmission member or element 16. With reference to FIG. 4, there will be considered the construction of the generator 24 in conjunction with the transmission member or element 16. It will be observed that the generator 24 has a shaft 28 which is disposed substantially coaxial with respect to the common lengthwise axis of the belt pulleys or pulley disks 16a, 16b and 16c of the transmission member 16. The pole wheel or rotor is indicated by reference numeral 29 and the stationary armature windings or armature coil has been designated by reference numeral 32. The rotation of the transmission member 16 also causes the pole wheel or rotor 29 of the generator 24 to rotate and current is thus induced in the stationary armature windings 32. The current or power is delivered to the control device or control 6 by means of a conductor or line 25 and this current supply is independent of the direction of travel or motion of the carriage 3. It will be apparent from the foregoing discussion that the system is designed such that power supply interruptions are effectively prevented even during stationary periods or standstill mode of the mobile carriage 3.

During movement of the servicing or working unit 40 along the track or rails 2, compressed or blow air flows through the aforementioned air guide elements or airflow ducts 10 or air is sucked into such air guide elements 10. The air guide elements or airflow ducts 10 are provided with elevationally adjustable nozzles 26. The air infeed or the suction of the air, as the case may be, is accomplished by the ventilator 5, the shaft 27 of which constitutes an extension of the common shaft of the belt pulleys or pulley disks 17a, 17b and 17c and which is driven by the related transmission member or element 17.

The terminal or limit switches 7a and 7b mounted on the carriage 3 cooperate with stops positioned at both ends of the track or rails 2, one of which stops 50 is shown in FIG. 1. These terminal or limit switches 7a and 7b are connected by lines or conductors 31 with the control device 6. At the region of these stops, a related one of the terminal or limit switches 7a or 7b is switched or thrown, causing the control device or control 6 to actuate the electromagnet 20 for shifting or changing the position of the belt guide member 21 for the front or closest situated strand or run 15b of the drive belt 15. This front strand or run 15b is now moved or shifted from its prior engagement with, for instance, the lower belt pulleys 16c, 17c and 18c so that it now engages or contacts the middle or intermediate belt pulleys 16b, 17b and 18b which are larger in diameter than the diameter of the upper belt pulleys 16a, 17a and 18a about which trains the rear or furthest situated strand or run 15a. This results in a change of travel direction of the carriage 3. It is worth further mentioning that the sensors or detectors 8a to 8d are arranged on the air guide elements or airflow ducts 10 and, for instance, could be ultrasonic sensors which upon approaching an obstacle likewise would bring about a reversal in the travel direction of the carriage 3 together with the air guide elements 10 attached thereto. As soon as an obstacle is detected by the sensors 8a to 8d, they transmit a suitable signal or pulse to the control device 6 which, in the above-described manner, activates the electromagnet or solenoid 20, causing the changeover or positional shift of the belt guide member 21, which results in a change of travel direction of the carriage 3. In this manner collisions of the air guide elements 10 with obstacles located in the path of motion of the working apparatus 1, i.e. the servicing unit 40, can be effectively prevented.

The reliability of the sensors 8a to 8d can still be increased and the possibility of faulty switching operations can be excluded if only the sensors located in the relevant or prevailing direction of travel of the working or servicing unit 1 are switched-on or activated.

In the manner described hereinbefore there is accomplished the high power drive for the movement of the carriage 3 and the ventilator 5 by the endless drive belt 15 which is driven by the stationary electric drive motor 12, whereas the low power drive, that is the low current supply for the control device or control 6 is accomplished by the brushless generator 24 arranged on the displaceable carriage 3.

While there are shown and described present preferred embodiments of the invention it is to be distinctly understood that the invention is not limited thereto, but may be otherwise variously embodied and practiced within the scope of the following claims. Accordingly,

What we claim is:

1. A working apparatus, especially a cleaning apparatus for use in conjunction with at least one textile machine and movable to-and-fro along track means in a predeterminate path of movement, comprising:

a servicing unit displaceable on said track means;

said servicing unit comprising:

control means for sensing obstacles located along the predeterminate path of movement of the working apparatus;

generating means for generating drive power for said control means;

said generating means being displaceable together with said servicing unit; and stationary drive means for driving said servicing unit and said generating means.

2. The working apparatus as defined in claim 1, wherein:

said servicing unit further comprising transmission members operatively connected with said servicing unit;

means for transmitting power from said stationary drive means to said transmission members; and said generating means being located in one of said transmission members.

3. The working apparatus as defined in claim 2, wherein:

said one transmission member containing a rotatable part;

said generating means comprising a drive member; and said drive member at said generating means being operatively connected to said rotatable part of said one transmission member.

4. The working apparatus as defined in claim 3, wherein:

said means for transmitting power from said stationary drive means to said transmission members comprises a drive belt;

each of said transmission members possessing three substantially coaxial pulleys of different diameters; and said drive belt operatively connecting said stationary drive means with at least one of said three coaxial pulleys of each of said transmission members.

5. The working apparatus as defined in claim 4, wherein:

said three coaxial pulleys of each of said transmission members comprising a first pulley, a second pulley and a middle pulley;

said first pulley having a smaller diameter than said second pulley;

said second pulley having a smaller diameter than said middle pulley;

said drive belt containing a first strand and a second strand;

said first strand extending in a first serpentine path of travel between said transmission members and being constantly operatively connected to said second pulley of each of said transmission members;

said second strand extending in a second serpentine path of travel between said transmission members;

said first serpentine path of travel of said first strand being substantially in mirror-image relationship to said second serpentine path of travel of said second strand; and means for selectively operatively connecting said second strand of said drive belt to either said middle pulley or said first pulley for selectively changing the direction of travel of said servicing unit.

6. The working apparatus as defined in claim 1, wherein:

said control means include contactless sensors responsive to the presence of obstacles located along said path of movement of the working apparatus; and said contactless sensors initiating reversal of movement of the servicing unit upon contactless detection of an obstacle along the predeterminate path of movement of the working apparatus.

7. A working apparatus, especially a cleaning apparatus for use in conjunction with at least one textile machine and movable to-and-fro along track means, comprising:

a servicing unit reciprocatably displaceable on said track means in a first predeterminate direction of travel and in a second predeterminate direction opposite to said first predeterminate direction of travel;

said servicing unit comprising:

control means for sensing obstacles located along the path of movement of the working apparatus;

generating means for generating drive power for said control means;

said generating means being displaceable together with said servicing unit;

stationary drive means for driving said servicing unit and said generating means;

means for transmitting drive power from said stationary drive means to said servicing unit;

said servicing unit comprising transmission members cooperating with said means for transmitting drive power for displacing said servicing unit and at least one of which transmission members operates said generating means; and said drive power transmitting means coacting by means of said at least one transmission member with said generating means for driving said generating means during travel of said servicing unit in both said first predeterminate direction of travel and in said second predeterminate direction of travel.

8. The working apparatus as defined in claim 7, wherein:

said generating means are located in said at least one transmission member;

said one transmission member containing a rotatable part;

said generating means comprising a drive member; and said drive member at said generating means being operatively connected to said rotatable part of said at least one transmission member.

9. The working apparatus as defined in claim 8, wherein:

said generating means comprises a brushless generator.

10. The working apparatus as defined in claim 7, wherein:

said drive power transmitting means coacting by means of said at least one transmission member with said generating means for driving said generating means during operation of said stationary drive means even during standstill of said servicing unit.

* * * * *